US010156125B2

(12) United States Patent
Connell et al.

(10) Patent No.: US 10,156,125 B2
(45) Date of Patent: Dec. 18, 2018

(54) ONE TRIP BLOWOUT PREVENTER CLEANING AND PRESSURE TESTING

(71) Applicant: ARCHER OILTOOLS AS, Stavanger (NO)

(72) Inventors: Paul Lowell Connell, Spring, TX (US); Lars Harald Norheim, Katy, TX (US); Clarence Vaughn Griffin, Spring, TX (US)

(73) Assignee: ARCHER OILTOOLS AS, Stavanger (NO)

( * ) Notice: Subject to any disclaimer, the term of this patent is extended or adjusted under 35 U.S.C. 154(b) by 122 days.

(21) Appl. No.: 15/114,295

(22) PCT Filed: Jan. 27, 2014

(86) PCT No.: PCT/NO2014/000005
§ 371 (c)(1),
(2) Date: Jul. 26, 2016

(87) PCT Pub. No.: WO2015/112021
PCT Pub. Date: Jul. 30, 2015

(65) Prior Publication Data

US 2017/0241239 A1 Aug. 24, 2017

(51) Int. Cl.

| | |
|---|---|
| ***E21B 37/00*** | (2006.01) |
| ***E21B 33/043*** | (2006.01) |
| ***E21B 33/068*** | (2006.01) |
| ***E21B 23/00*** | (2006.01) |
| ***E21B 33/064*** | (2006.01) |
| ***E21B 33/12*** | (2006.01) |

(Continued)

(52) U.S. Cl.
CPC ..... *E21B 37/00* (2013.01); *E21B 23/00* (2013.01); *E21B 33/043* (2013.01); *E21B 33/064* (2013.01); *E21B 33/068* (2013.01); *E21B 33/12* (2013.01); *E21B 47/06* (2013.01); *E21B 17/01* (2013.01)

(58) Field of Classification Search
CPC ..... E21B 37/00; E21B 23/00; E21B 33/064; E21B 33/12; E21B 47/06; E21B 17/01
See application file for complete search history.

(56) References Cited

U.S. PATENT DOCUMENTS 7,031,840 B1 4/2006 Brett et al.
2010/0116504 A1* 5/2010 Hoffman ..... E21B 29/12 166/336

(Continued)

*Primary Examiner* — Yong-Suk Ro
(74) *Attorney, Agent, or Firm* — Birch, Stewart, Kolasch & Birch, LLP

(57) ABSTRACT

A bottom hole assembly (BHA) has a plug below a debris catcher and an optional telescoping joint. A cleaning tool is above the debris catcher with another cleaning tool further up the BHA that is designed to clean the riser that extends up from the BOP. The plug is spotted and released to commence the BOP cleaning and the riser cleaning. The cleaning tools can be reconfigured to allow through flow after the cleaning is done so that the rams can be closed around a drill collar and a pressure test take place. With the BHA above the BOP the rams can be closed against each other for another pressure test from above. In a variety of options for the method, the plug can be retrieved after released or left in the hole in the set position.

17 Claims, 23 Drawing Sheets

(51) Int. Cl.
*E21B 47/06* (2012.01)
*E21B 17/01* (2006.01)

(56) References Cited

U.S. PATENT DOCUMENTS

| | | | | |
|---|---|---|---|---|
| 2011/0017463 | A1* | 1/2011 | El Azm | E21B 17/015 166/311 |
| 2012/0160509 | A1* | 6/2012 | Caldwell | E21B 43/0122 166/363 |
| 2012/0205108 | A1 | 8/2012 | Stang | |
| 2012/0211229 | A1* | 8/2012 | Fielder | E21B 37/00 166/311 |
| 2012/0227974 | A1 | 9/2012 | Caulfield et al. | |
| 2014/0096972 | A1* | 4/2014 | Leiper | E21B 31/06 166/311 |

* cited by examiner

BOP being cleaned

BHA being pulled out of the hole (POOH)

"Running in position"

Secnd option : Running in position

Plug is set and released from BHA

BOP being cleaned testing BOP

BHA moving down to reconnect to plug
(and to unset plug)

BHA beeing POOH
(withe the plug unset)

BHA being run in

Plug not set cleaning commences

Plug is set

PBOP cleaned

BOP being pressure tested

BHA going down to release plug

BHA being POOH with the plug

Fourth option

Run in position

Fourth option

Plug unset

Plug not

Cleaning the BOP

Plug unset (not set)

BOP beeing pressure tested

BHA beeing POOH leaving the plug in the hole

ONE TRIP BLOWOUT PREVENTER CLEANING AND PRESSURE TESTING

FIELD OF THE INVENTION

The field of the invention is cleaning debris from a blowout preventer and conducting a pressure test in a single trip.

BACKGROUND OF THE INVENTION

Blowout preventers (BOP) must be regularly pressure tested in order to ascertain their function. Prior methods took two separate trips for cleaning debris from the blowout preventer's internal components and capturing such debris either on a debris removal device that was part of a bottom hole assembly (BHA) or by circulation flow during the cleaning. When the cleaning process was done a separate trip with a packer set below the BOP was undertaken to pressure test the BOP. This additional trip created delay and additional cost and the objective of the present invention is to accomplish the cleaning of the BOP in the same trip as the pressure testing of the BOP. Variations are described where the plug used in the BHA is either left in the well or retrieved. Those skilled in the art will more readily appreciate various aspects of the present invention from a review of the detailed description of the preferred embodiment and the associated drawings.

U.S. Pat. No. 7,031,840 generally describes methods for optimization of drilling time and makes reference to borehole cleaning as part of that process.

SUMMARY OF THE INVENTION

A bottom hole assembly (BHA) has a plug below a debris catcher and an optional telescoping joint. A cleaning tool is above the debris catcher with another cleaning tool further up the BHA that is designed to clean the riser that extends up from the BOP. The plug is spotted and released to commence the BOP cleaning and the riser cleaning. The cleaning tools can be reconfigured to allow through flow after the cleaning is done so that the rams can be closed around a drill collar and a pressure test take place. With the BHA above the BOP the rams can be closed against each other for another pressure test from above. In a variety of options for the method, the plug can be retrieved after released or left in the hole in the set position.

More specifically, the invention is a petroleum well BOP (10) cleaning and pressure testing method, comprising the steps of:

- tripping out a portion of a drilling string (42),
- arranging a borehole assembly (18) comprising a cleaning tool (36) and a disconnector (22) and a plug (21) on the remaining part of said drilling string (42)
- lowering said borehole assembly (18) on a string of drill pipes to below said BOP (10);
- setting said plug (21) which suspends said remaining part of said drilling string (42),
- disconnecting said disconnector (22),
- running said cleaning tool (36) in said BOP (10),
- pressure testing said BOP (10),
- reconnecting said disconnector to said plug (21), unsetting said plug (21), and retrieving said borehole assembly (18) and the top of said remaining part of said drilling string (42) to the surface,
- reassembling said drilling string (42) to the bottom of the hole and resuming drilling.

The invention is also a petroleum well BOP (10) cleaning and testing assembly (18) comprising

- a plug (21) arranged for being set in a well and for holding a borehole tool such as a drilling string (42),
- a disconnector/connector (22) arranged above said plug (21) and below
- a BOP (10) cleaner tool (36) arranged for being suspended in a drill pipe string (40) from a drilling vessel.

BRIEF DESCRIPTION OF THE DRAWINGS

FIG. 12 is a third option of the method showing the BHA being run in;

DETAILED DESCRIPTION OF THE PREFERRED EMBODIMENT

Figure 1:
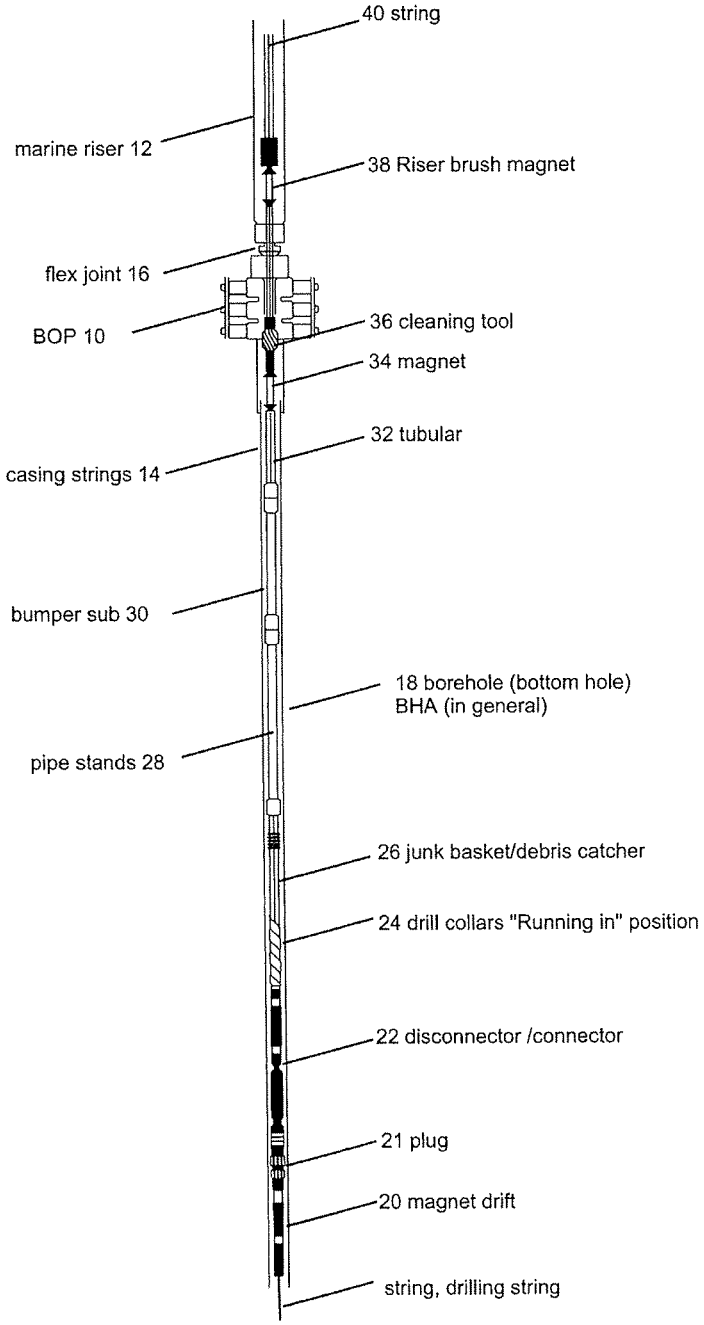
FIG. 1 is a first option of the method showing the running-in position. In this first option there is a string (42) hanging under the plug.

FIGS. 1-6 illustrate a first option of the method where the BOP 10 is situated below a marine riser 12 with the casing strings 14 supporting the BOP 10. A flex joint 16 is placed between the BOP 10 and the riser 12. The BHA 18 is run in on a string 40 from a vessel or a platform in an offshore application and will be described going from the bottom up. A magnetic drift 20 is on the bottom. It guides the BHA 18 and picks up magnetic debris that may be in the borehole ahead of the plug 21. Plug 21 has a disconnect 22 so that when the plug 21 is set the BHA 18 above the disconnect 22 can be moved up for the cleaning of the BOP 10. Drill collars 24 weigh down the BHA for ease of running in. A junk basket or some other type of debris catcher 26 is used to catch any debris that manages to go further downhole during the cleaning of the BOP 10 with the cleaning tool 36. The debris catcher 26 is a known design and can have a plurality of biased fingers that trap debris between the fingers.

Above the debris catcher 26 there are several stands of pipe 28 for spacing purposes for the plug 21 when the cleaning tool 36 is at the position just below the BOP 10. A long stroke bumper sub 30 is used to compensate for vessel or platform movement due to wave action and can be optionally omitted where such movement compensation is not an issue. More tubular stands 32 are above the bumper sub 30 followed by a magnet 34 that catches debris from the cleaning tool 36. The cleaning tool 36 is a known design that has spiral flow passages and circulation ports for jetting action as well as brushes on the raised portions that define the spiral paths. The tool 36 can be configured to direct flow straight through instead of out laterally through the cleaning jets by dropping an object such as a dart and shifting a sleeve to allow the dart or object to release for a flow through central bore. As seen in FIG. 1 the magnet and riser brush assembly 38 is spaced to be at the riser 12 bottom when the cleaning tool 36 is at the bottom of the BOP 10. Optionally, the BHA 18 can continue beyond the magnetic drift 20 with a string such as a drilling string and other tools that are schematically represented as 42. If the plug 21 stays in the hole after the pressure testing of the BOP 10 then the portion of the BHA 18 below the set plug 21 would clearly also remain in the hole. (In this case the BHA here illustrated could rather be called a "borehole assembly" than a "bottomhole assembly".)

Figure 2:
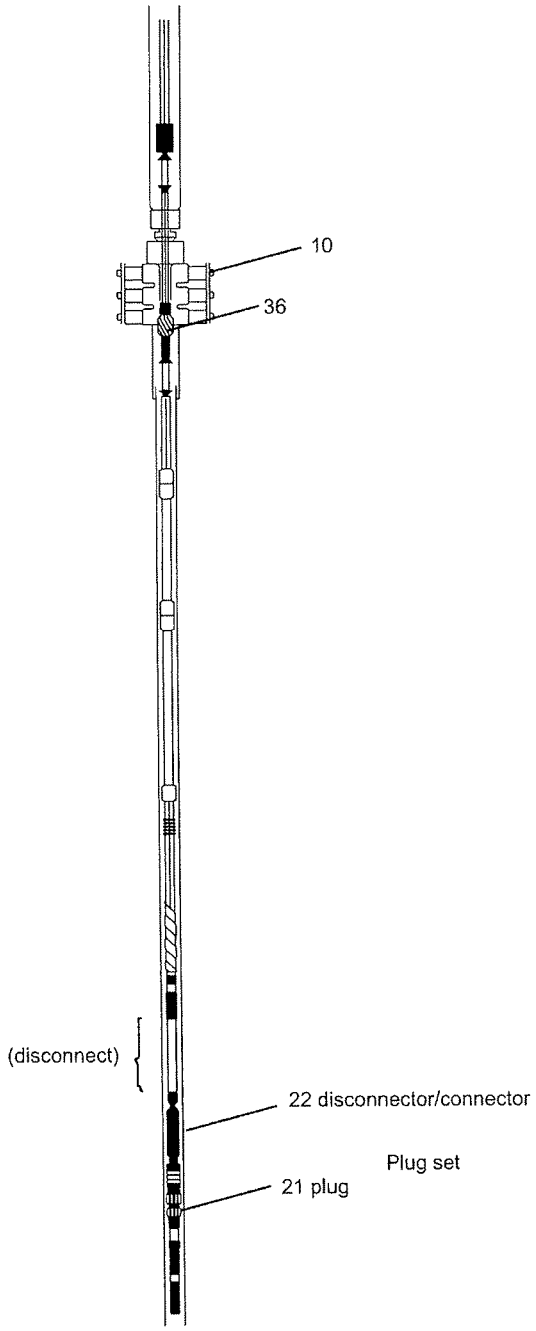
FIG. 2 is the view of FIG. 1 showing the plug set with the string suspended in the plug.
Figure 3:
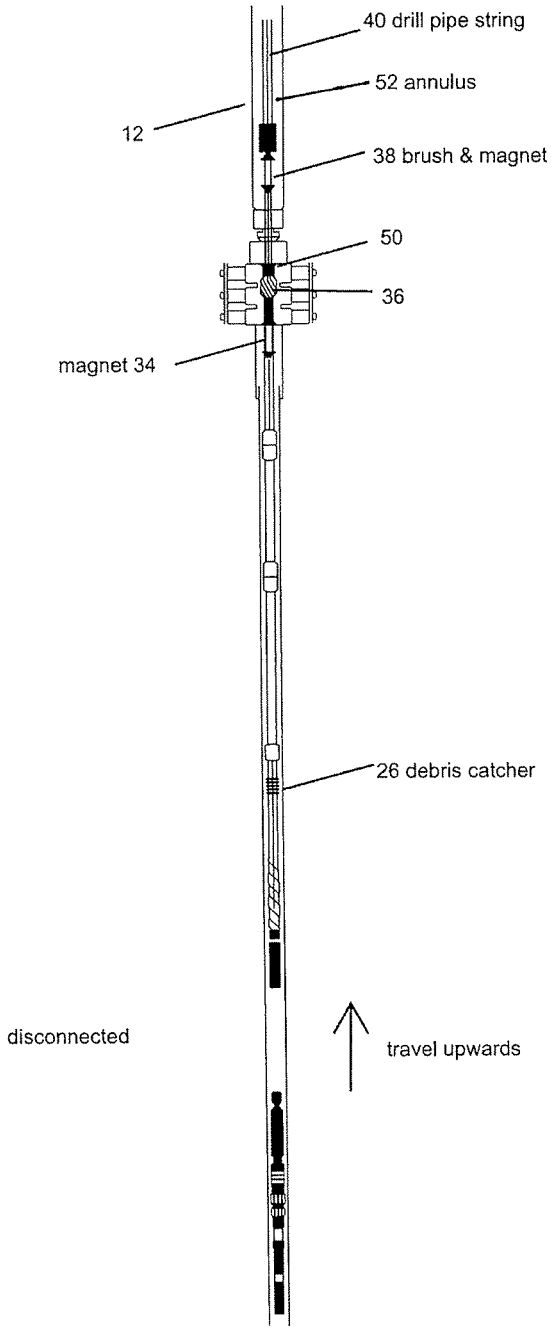
FIG. 3 is the view of FIG. 2 showing the BOP being cleaned internally.

With the major components described, the various options for the method can now be explained. As states, FIG. 1 is the position after running in to the desired location. In FIG. 2 the plug 21 is set and the disconnect 22 is released so that the remainder of the BHA 18 can be pulled up to put the cleaning device 36 in position just below the BOP 10. In FIG. 3 circulation is initiated through the jet ports in the cleaning device 36 as represented by the arrow 50. Most of the debris is circulated out of the well through the annulus 52 in the riser 12. Should any magnetic debris fall down the hole the magnet 34 can get it. If the falling debris is not magnetic or for some reason does not adhere to the magnet 34 then the debris catcher 26 can collect such debris and bring it to the surface when the BHA 18 is removed from the well. The cleaning step can also involve rotation or reciprocation of the string 40 to aid the scrubbing process. At the same time the magnet/brush 38 is scraping the riser 12 and capturing some of the debris with the magnet that is part of that assembly. At the end of the cleaning, the cleaning device 36 can be reconfigured for through flow as opposed to lateral flow out the cleaning nozzles by dropping an object or a dart (not shown) to move a sleeve to close the lateral port and open the through port when the dart or object exit the cleaning tool 36.

Figure 4:
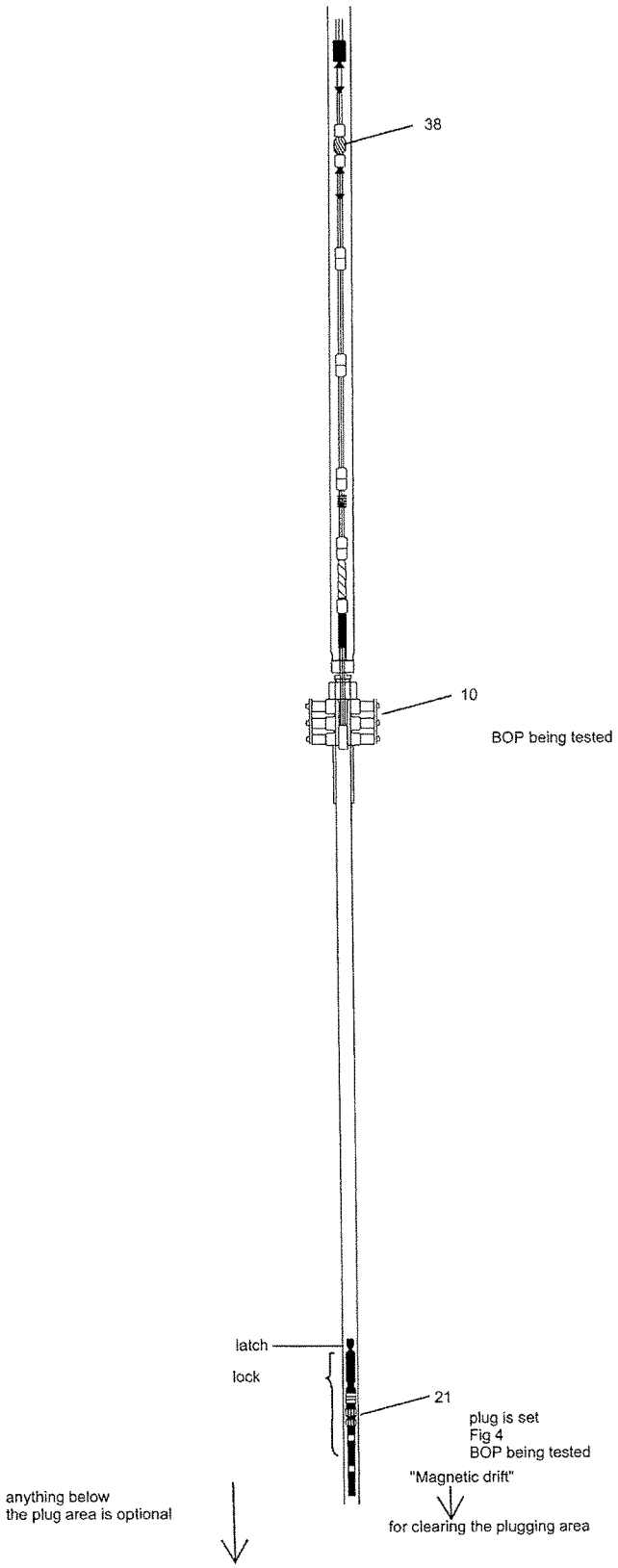
FIG. 4 is the view of FIG. 3 showing the BOP being tested. It may be tested by leaving a pipe of the toolstring through the BOP and setting pressure through the string to establish pressure below the BOP and above the plug, or pulling the toolstring entirely above the BOP and setting pressure from above.
Figure 5:
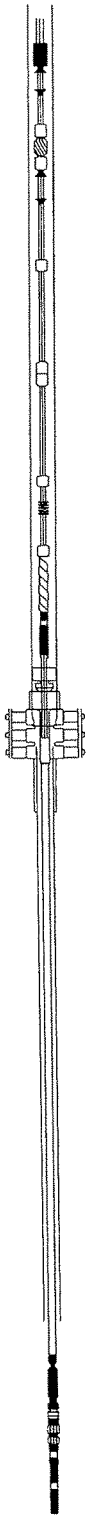
FIG. 5 is the view of FIG. 4 showing the BHA being pulled out of the hole (POOH) with the plug left set in the hole.
Figure 6:
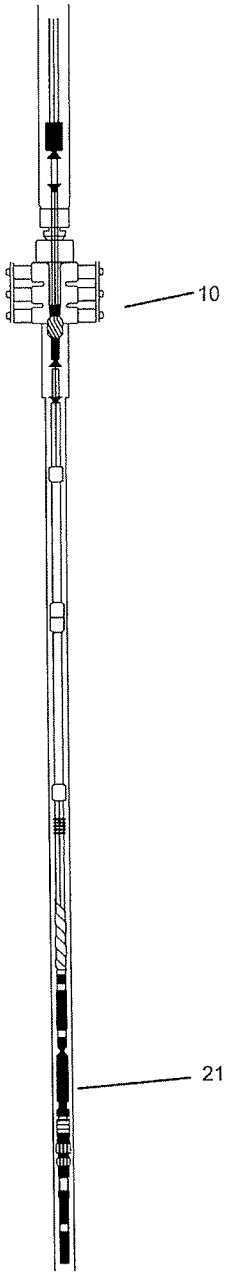
FIG. 6 is a second option of the method showing the running-in position. Below the plug is a magnetic tool for cleaning the casing wall before the plug is set, instead of a string (drillstring etc.) suspended below the plug.
Figure 7:
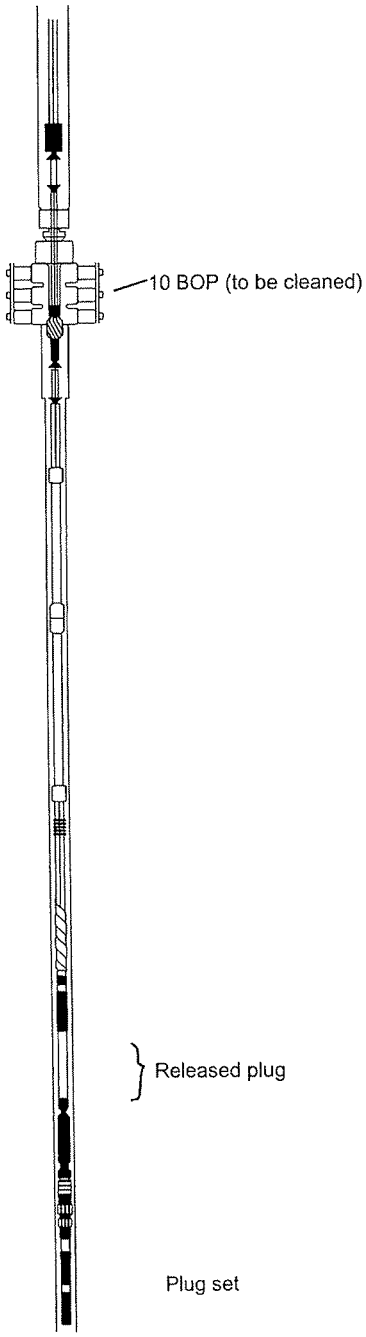
FIG. 7 is the view of FIG. 6 showing the plug being set and released from the BHA.
Figure 8:
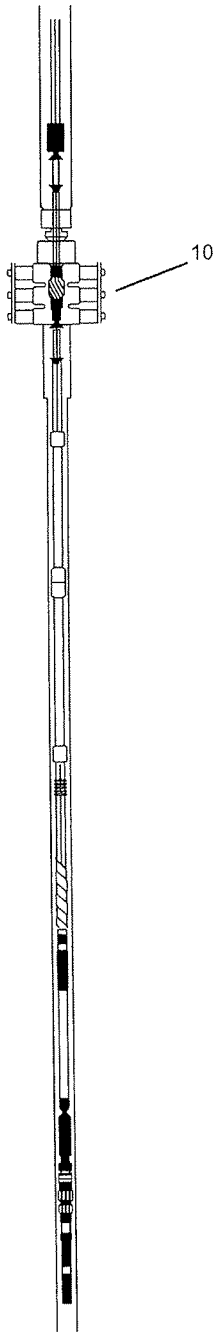
FIG. 8 is the view of FIG. 7 showing the BOP being cleaned.
Figure 9:
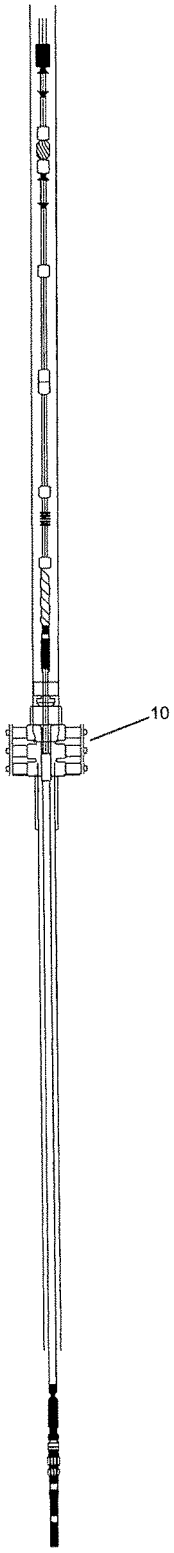
FIG. 9 is the view of FIG. 8 showing the BOP being tested either having a pipe string through the BOP for setting pressure below BOP or the pipe string pulled above the BOP and closing the BOP for testing the BOP setting pressure above.

As seen in FIG. 4 the BHA 18 is pulled above the BOP 10 except for the plug 21 and what is below it which remains behind with the plug 21 still set. Pressure is applied through the BHA 18 and down to the set plug 21 to test the integrity of the BOP 10. Alternatively the rams, of which three are shown can close on tubulars 32 or 28 and the test can be conducted for the BOP 10 clamped onto the BHA 18 with the plug 21 serving as the bottom pressure retaining device. FIG. 5 shows that at the conclusion of the pressure test the BHA 18 is pulled out of the hole (POOH) while leaving the plug 21 and anything it supports below remaining in the well.

Figure 10:
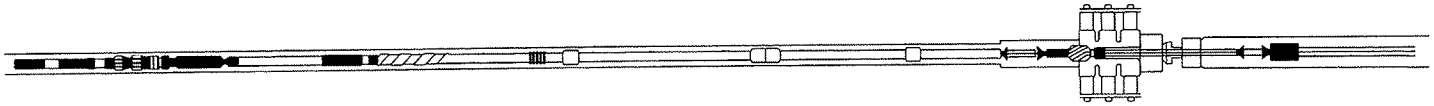
FIG. 10 is the view of FIG. 9 showing the BHA moving through the BOP to unset the plug and retain the plug.
Figure 11:
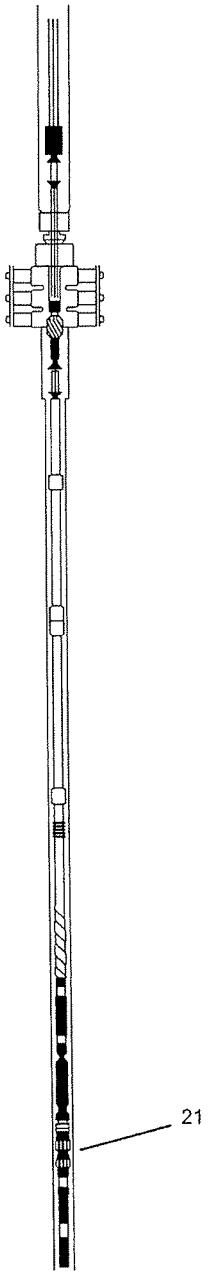
FIG. 11 is the view of FIG. 10 with the BHA being POOH with the plug.
Figure 12:
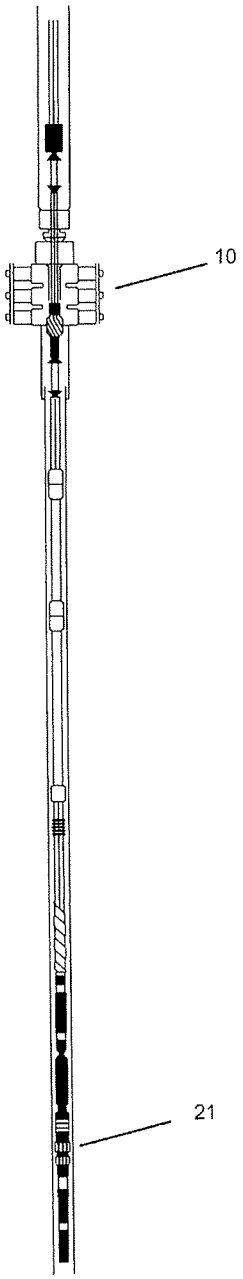

FIGS. 6-11 represent another order for the method using the same parts. FIGS. 6-9 correspond to FIGS. 1-4 and the method thus far is unchanged. In FIG. 10 the BHA 18 is lowered to release plug 21 after re-latching into it. In FIG. 11 the BHA 18 is POOH with the released plug 21 and any other components that it supports.

Figure 13:
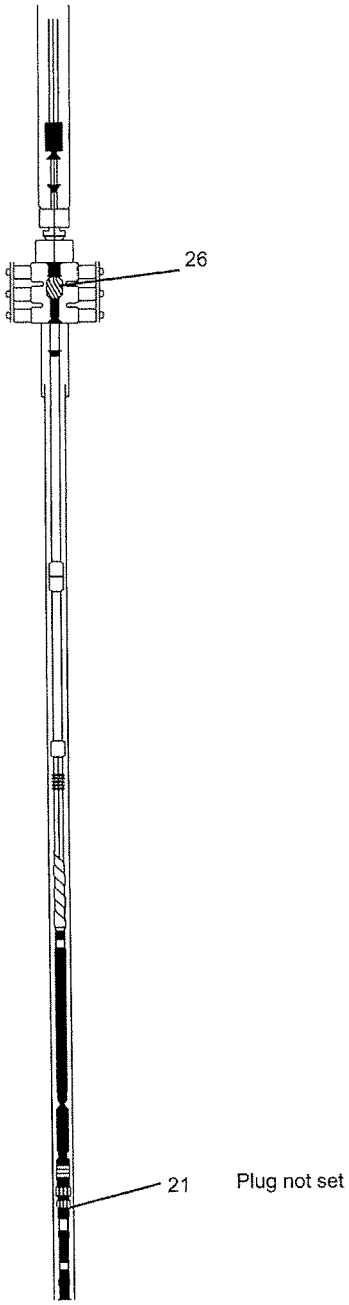
FIG. 13 is the view of FIG. 12 showing the plug not set.
Figure 14:
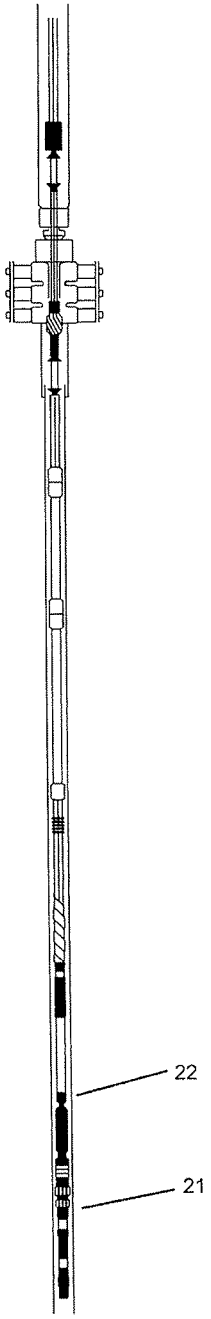
FIG. 14 is the view of FIG. 13 showing the plug set and the BOP being cleaned.
Figure 15:
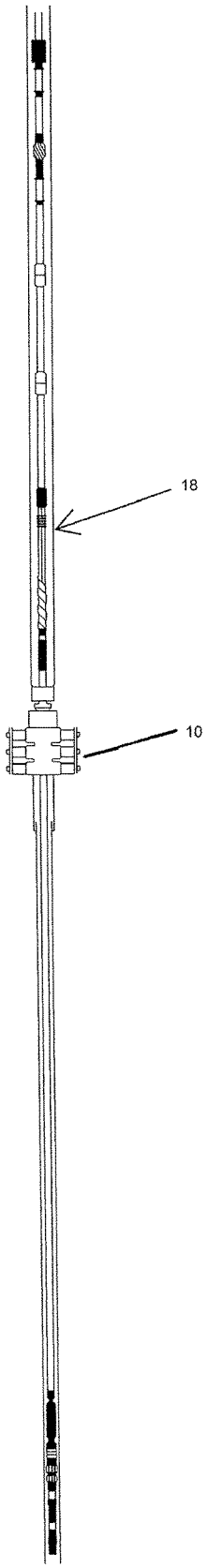
FIG. 15 is the view of FIG. 14 showing the BOP being pressure tested.
Figure 16:
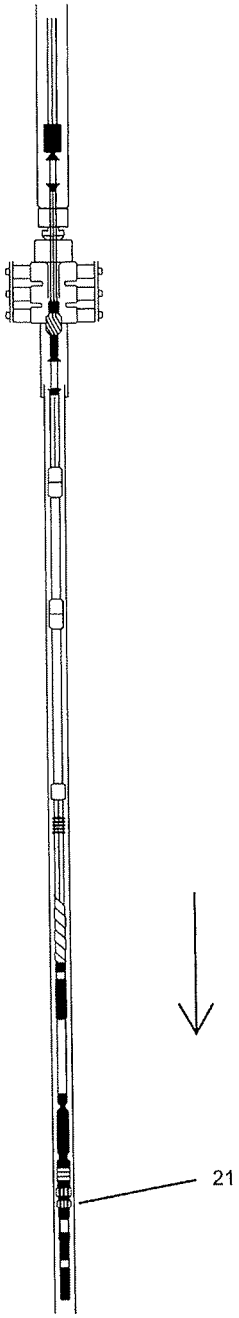
FIG. 16 is the view of FIG. 15 showing the BHA going through the BOP to release the plug.
Figure 17:
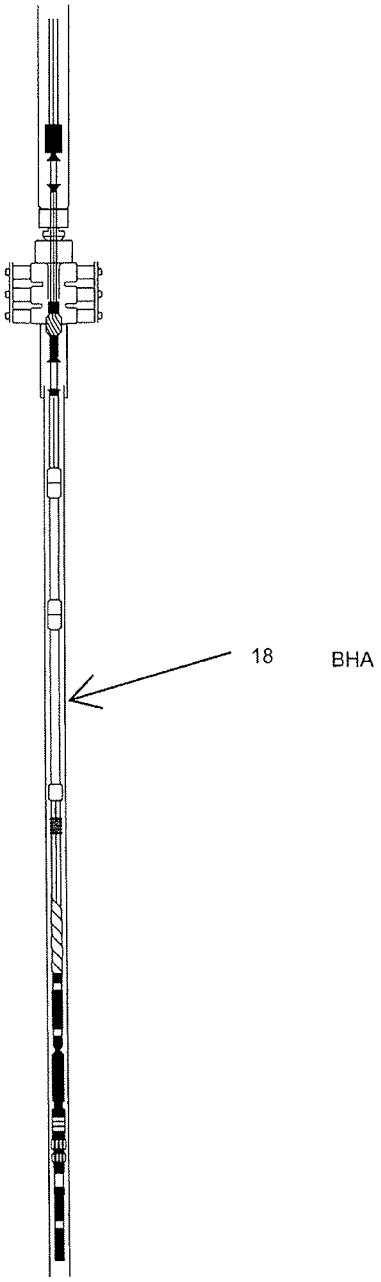
FIG. 17 is the view of FIG. 16 showing the BHA being POOH with the plug.

In the third option, the BHA 18 is run in as before but this time the plug 21 is not set before the cleaning with the cleaning device 26 starts. In FIG. 13 the cleaning commences with the cleaning device 26 as previously described and then in FIG. 14 the plug 21 is set and released at the disconnect 22. In FIG. 15 the BHA 18 is pulled above the BOP 10 for the pressure test as described before. In FIG. 16 the plug 21 is about to be engaged to be grasped and then released so that in FIG. 17 it is removed with the BHA 18.

Figure 18:
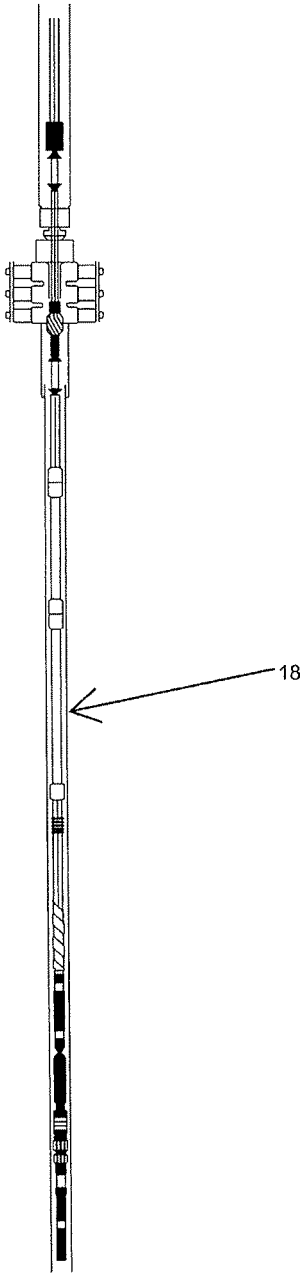
FIG. 18 is a fourth option of the method in the run in position.
Figure 19:
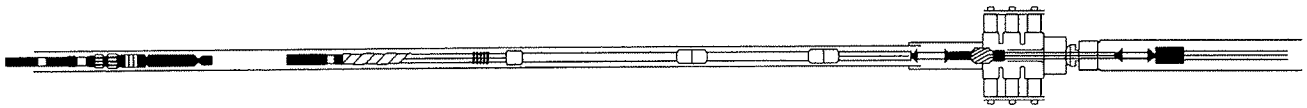
FIG. 19 is the view of FIG. 18 showing the plug set.
Figure 20:
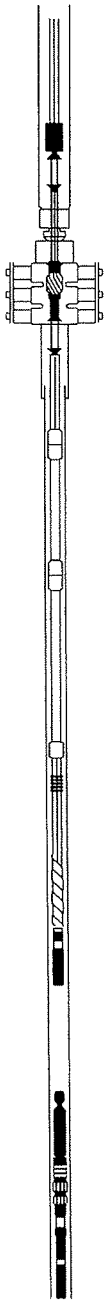
FIG. 20 is the view of FIG. 19 showing the cleaning of the BOP.
Figure 21:
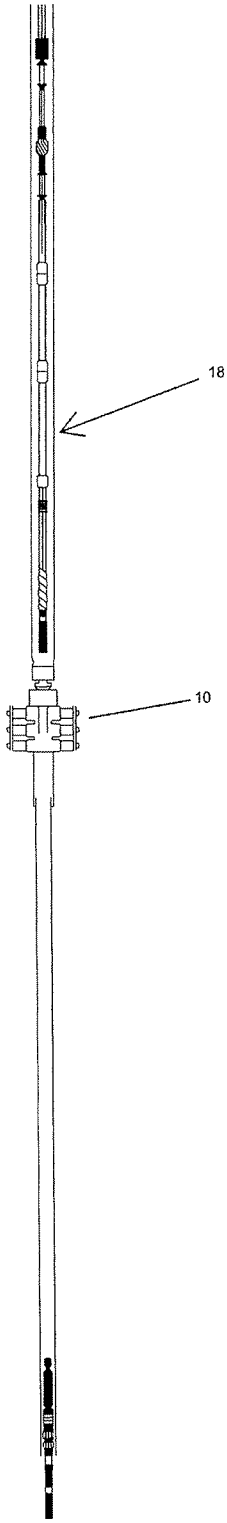
FIG. 21 is the view of FIG. 20 showing the BOP being pressure tested.
Figure 22:
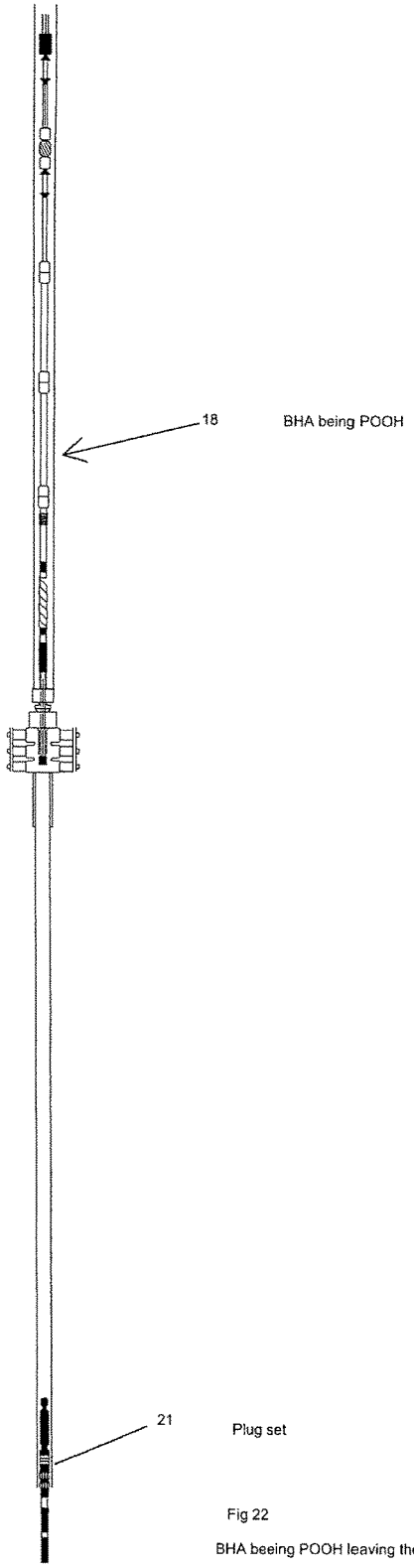
FIG. 22 is the view of FIG. 21 with the BHA being POOH while leaving the plug in the hole.

In FIGS. 18-22 the BHA 18 is run in in FIG. 18 to the desired location as shown in FIG. 19. The cleaning commences in FIG. 20 with the cleaning device 26 with the plug 21 unset. The plug 21 is then set and released as in FIG. 22 and the BHA 18 is raised above the BOP 10 for the pressure test. The plug 21 is then left in the hole and the BHA is removed through the riser 12 as shown in FIG. 22.

Those skilled in the art will appreciate that what is described is a one trip technique for running in and cleaning a BOP with a plug set or unset and either leaving the plug in the hole after the pressure test or removing the plug after the pressure test by re-latching onto it and releasing it for ultimate removal. The plug in all these options can have further tools secured to itself. What was previously done in discrete trips now can be done in a single trip.

A significant advantage of the invention is that a major part drill string may be hung off below a plug in the well instead of tripping out the entire drill string before plugging the well and pressure testing the BOP. This may also prove to save much time in case using the plug as a storm lock plug in order to hang off the drill string in the hole and pressure testing the BOP before having to disconnect. After reconnecting the same tool is used to pressure test the BOP and remove the plug and resume the drilling operation. One may conduct pressure testing above the plug and below the BOP because the plug is able to hold the drill string which may be several kilometers long.

Figure 23:
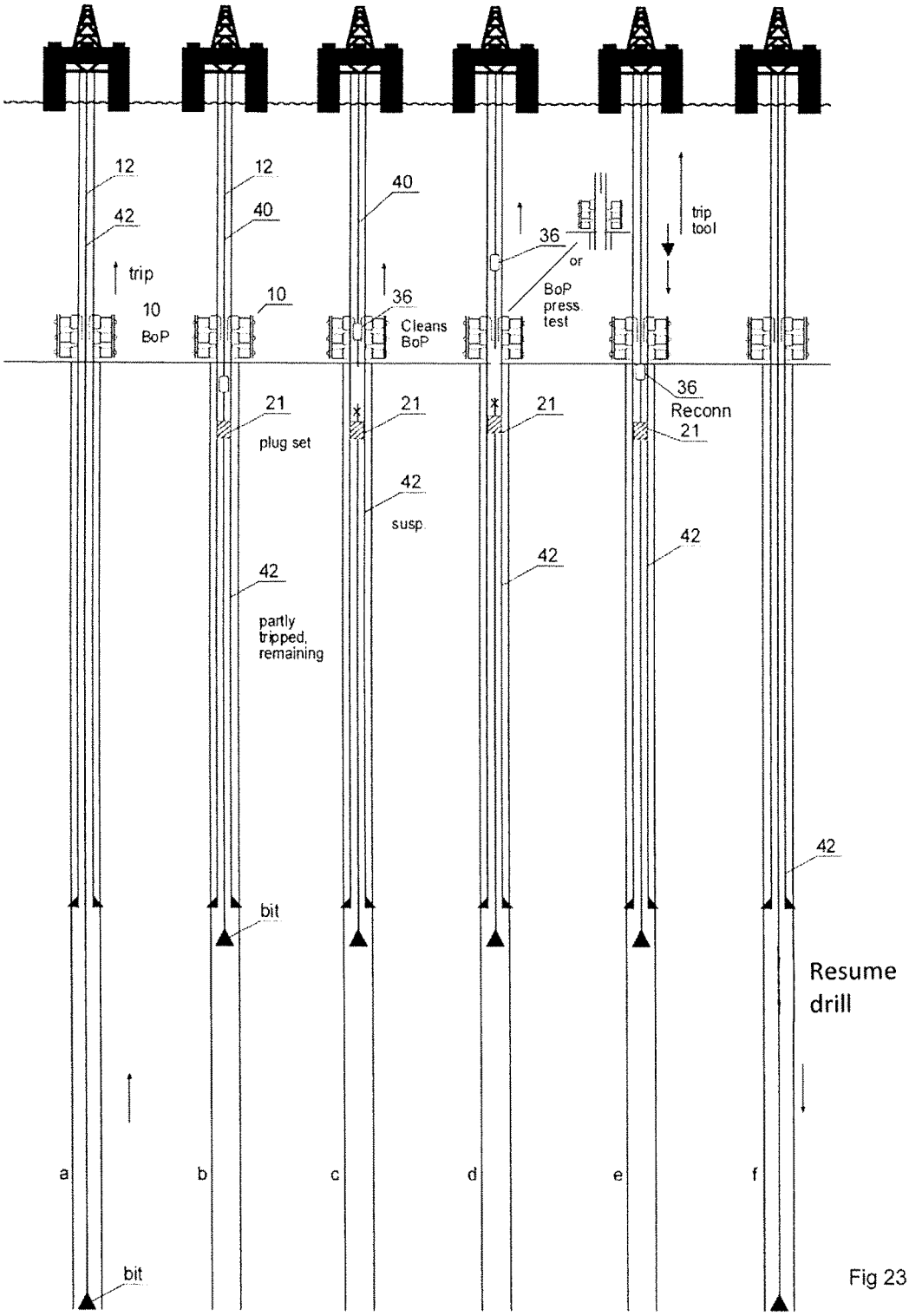
FIG. 23 is a series of steps showing the use of the invention wherein a drilling string is hung off suspended in the plug while the BOP is being cleaned, until the entire drilling string is reestablished in the well

FIG. 23 is a series of steps showing the use of the invention wherein a drilling string is hung off suspended in the plug while the BOP is being cleaned, until the entire drilling string is reestablished in the well.

FIG. 23*a* illustrates a drill string (42) in a drilling position in a well and suspended from the drilling rig at the sea. The drill string extends through a riser (12) and further through a BOP (10) into the well. The drill string (42) is, according to the method, tripped out by a length of drill pipes corresponding to deeper than the BOP (10), then a borehole assembly (18) according to the invention comprising at least a plug (21), a disconnector/connector (22), and a cleaning tool (26) is inserted onto the remaining drilling string and lowered using drill pipes with the plug (21) into the casing and with the cleaning tool (36) below the BOP (10). Then the plug (21) is set in FIG. 23*b*. In FIG. 23*c* the borehole assembly (18) is disconnected from the set plug, which suspends the drilling string (42) in the borehole, and the cleaning tool (36) is run through the BOP (10). Flushing fluid may be supplied to the cleaning tool (36) through the drill pipes suspending the cleaning tool (36). The BOP (10) may in the situation illustrated in FIG. 23*d* be closed entirely and pressure tested from above or below, and/or closed about a lower portion of drill pipe and pressure tested through establishing pressure through the drill pipes holding the cleaning tool (36), and the plug. Then the drill pipes with the assembly (18) is lowered and reconnected with the plug (21), the plug unset, and the assembly (18) with the plug (21) and the cleaning tool may be retrieved to the surface as illustrated in FIG. 23*e*. FIG. 23*f* illustrates drilling ready to be resumed.

Variations of the sequence of cleaning, disconnecting, pressure testing and re-latching/reconnecting are possible.

Another variation of the method is that after the plug (21) has been set and the BOP (10) preferably has been pressure tested, the riser should be ready for being emergency disconnected in order to ride off a storm. After the storm, with or without having disconnected the riser, one is back to the situation illustrated in FIG. 23*d*, wherein one may conduct pressure testing, reconnecting and retrieving the plug, and lower the drilling string to resume drilling as shown in FIG. 23*f*.

We claim:

1. A one trip blowout preventer (BOP) (10) cleaning and pressure testing method, comprising the steps of:

running in a borehole assembly (BHA) (18) with a plug (21) and at least one cleaning device (36), in a single trip, into a subsea location comprising a marine riser (12), a blowout preventer (BOP) (10) and casing strings (14);

setting said plug (21) below said blowout preventer (BOP) (10);

cleaning said blowout preventer (BOP) (10) at the subsea location with said cleaning device (36);

pressure testing against said plug (21); and removing at least said cleaning device (36) from said subterranean location.

2. The method of claim 1, further comprising the steps of:

releasing said plug (21) after said pressure testing; and removing said plug (21) with said BHA (18).

3. The method of claim 1, further comprising the steps of:

releasing said BHA (18) from said plug (21) after said setting said plug (21);

repositioning said BHA (18) to locate said cleaning device (36) adjacent said BOP (10); and cleaning said BOP (10) with said plug (21) set.

4. The method of claim 3, further comprising the step of:

leaving said plug (21) set when removing said BHA (18) after said pressure testing.

5. The method of claim 3, further comprising the steps of:

re-latching said connector (22) to said plug (21) after said pressure testing; and releasing and removing said plug (21) with said BHA (18) after said pressure testing.

6. The method of claim 1, further comprising the step of:

catching debris from said cleaning process with a magnet (34) arranged below said cleaning device (36) and above said plug (21).

7. The method of claim 1, further comprising the step of:

circulating fluid through said BHA (18) while cleaning with said cleaning device (36).

8. The method of claim 7, further comprising the step of:

allowing fluid to exit laterally through said cleaning device (36) during said cleaning.

9. The method of claim 8, further comprising the step of:

removing some debris in an uphole direction with said laterally exiting fluid.

10. The method of claim 9, further comprising the step of:

collecting some debris that moves in a downhole direction with a debris retention device (26) on said BHA (18).

11. The method of claim 8, further comprising the step of:

reconfiguring a flow pattern through said cleaning device (36) after said cleaning and before said pressure testing.

12. The method of claim 1, further comprising the steps of:

leaving said plug (21) initially unset during said cleaning;

setting said plug (21) after said cleaning; and leaving said plug (21) set when removing said BHA (18) after said pressure testing.

13. The method of claim 1, further comprising the steps of:

leaving said plug (21) initially unset during said cleaning;

setting said plug (21) after said cleaning;

releasing said connector (22) from said plug (21) before said pressure testing;

re-latching said connector (22) to said plug (21) after said pressure testing; and releasing and removing said plug (21) including (18) after said pressure testing.

14. The method of claim 1, further comprising the step of:

using a second cleaning device (38) to clean said riser (12) while a first said cleaning device (36) cleans said BOP (10).

15. The method of claim 1, further comprising the step of:

performing said pressure testing with said BHA (18) either above said BOP (10) or within said BOP (10).

16. A petroleum well blowout preventer BOP (10) cleaning and pressure testing method, comprising said steps of:

tripping out a portion of a drilling string (42) from a well, leaving a remaining part of said drilling string (42) in said well;

arranging a borehole assembly BHA) (18) comprising a cleaning tool (36) and a connector (22) and a plug (21) on a top of said remaining part of said drilling string (42);

lowering said BHA (18) on a string (40) of drill pipes to below said BOP (10);

setting said plug (21) which suspends said remaining part of said drilling string (42) in said borehole;

disconnecting said connector (22) from said plug (21);

running said cleaning tool (36) in said BOP (10);

pressure testing said BOP 00) against said plug (21);

reconnecting said connector (22) to said plug (21), unsetting said plug (21), and retrieving said BHA (18) until said top of said remaining part of said drilling string (42) is at said surface; and reassembling said drilling string (42) to said bottom of said hole and resuming drilling.

17. The method of claim 16, further comprising the step of:

pressure testing said BOP (10) with a lower part of said drill pipes (40) or said BHA (18) through said BOP (10).

* * * * *